US008500607B2

(12) United States Patent
Vittone et al.

(10) Patent No.: US 8,500,607 B2
(45) Date of Patent: Aug. 6, 2013

(54) MULTI-POSITIONABLE RESISTANCE EXERCISE APPARATUS

(76) Inventors: Larry W. Vittone, Hurley, WI (US); Suzanne R. Vittone, Hurley, WI (US)

( * ) Notice: Subject to any disclaimer, the term of this patent is extended or adjusted under 35 U.S.C. 154(b) by 277 days.

(21) Appl. No.: 13/004,959

(22) Filed: Jan. 12, 2011

(65) Prior Publication Data

US 2012/0178596 A1 Jul. 12, 2012

(51) Int. Cl.
*A63B 21/00* (2006.01)

(52) U.S. Cl.
USPC ..... 482/93; 482/94; 482/102; 482/103

(58) Field of Classification Search
USPC ..... 482/93, 94, 95, 96, 97, 98, 99, 100, 482/101, 102, 103
See application file for complete search history.

(56) References Cited

U.S. PATENT DOCUMENTS

| | | | | |
|---|---|---|---|---|
| 5,803,876 | A * | 9/1998 | Hickman | 482/72 |
| 7,597,655 | B2 * | 10/2009 | Webber et al. | 482/136 |
| 8,086,926 | B2 * | 12/2011 | Kato | 714/741 |
| 2002/0013200 | A1 * | 1/2002 | Sechrest et al. | 482/98 |
| 2003/0017918 | A1 * | 1/2003 | Webb et al. | 482/94 |
| 2012/0035026 | A1 * | 2/2012 | Lyszczarz | 482/103 |

* cited by examiner

*Primary Examiner* — Jerome W Donnelly
(74) *Attorney, Agent, or Firm* — Luedeka Neely Group, P.C.

(57) ABSTRACT

An exercise apparatus is disclosed including one or more interface members which allow a user to engage the exercise apparatus with one or more of the user's appendages and encounter resistance with high freedom of motion. The location of the interface member relative to the user is preferably repositionable in both a vertical orientation and a horizontal orientation. Resistance is preferably provided in part by a pulley system including a cord and a movable weight bearing member.

20 Claims, 11 Drawing Sheets

MULTI-POSITIONABLE RESISTANCE EXERCISE APPARATUS

FIELD

This disclosure relates to the field of exercise equipment. More particularly, this disclosure relates to exercise machines for exercise involving weight resistance features.

BACKGROUND

Resistance exercise machine technology has many benefits, but one common drawback is most if not all resistance exercise machines offer a limited range of motion. Such machines also are limited in the type of exercise a user can perform, limiting the muscle groups a user can exercise with a given machine.

What is needed, therefore, is an exercise apparatus providing an expansive range of motion and the flexibility to provide for a large variety of types of exercises that can be performed on the same machine.

SUMMARY

The above and other needs are met by an exercise machine including a cord, a frame, a first redirecting apparatus, a user interface, and a moveable weight-bearing member. The frame further includes: a foundation, a first column attached adjacent the foundation and oriented substantially orthogonal to the foundation, a second column attached adjacent the foundation and oriented substantially orthogonal to the foundation, and an upper beam attached adjacent a first end of the first column, attached adjacent a first end of the second column, and oriented substantially orthogonal to the first column and the second column.

The first redirecting apparatus which is attached adjacent the upper beam is useful for redirecting the orientation of a portion of the cord from a first direction to a second direction. A first end of the cord is attached adjacent a location of the redirecting apparatus that is stationary relative to the second column and the upper beam.

The user interface is attached adjacent the second column and includes: a hub, an arm member, and an input apparatus. The arm member includes a proximal end, attached adjacent to and extending from the hub, and a distal end. Additionally, a second redirecting apparatus for redirecting the orientation of a portion of the cord from the second direction to a third direction is attached adjacent the arm member. The input apparatus, mounted along the arm member, includes: a shaft, a coupling apparatus, a rotation plate, a redirecting member, an engagement interface, and an engagement extension. The coupling apparatus maintains attachment between the input apparatus and the arm member. The shaft is attached adjacent the coupling apparatus. The rotation plate is rotatable about an axis defined by the lengthwise orientation of the shaft. The redirecting member is attached adjacent a distal end of the rotation plate wherein the cord is oriented partially about the redirecting member such that when the exercise apparatus is not in use, the cord approaches the redirecting member in an orientation in the third direction and the cord exits the redirecting member in an orientation in a fourth direction. A user can physically engage a user's appendage with the exercise apparatus via the engagement interface member. Finally, the engagement extension includes a first end and a second end. The first end of the engagement extension is attached adjacent a second end of the shaft, and the second end of the engagement extension is attached adjacent the engagement interface member.

The movable weight bearing member, attached adjacent the portion of the cord oriented in the first direction, moves in response to the redirecting member forcing the portion of the cord oriented in the third direction to deviate from the third direction in response to a user rotating the rotation plate in a positive rotational direction. Alternatively, the movable weight member may move in response to the redirecting member forcing the portion of the cord oriented in the fourth direction to deviate from the fourth direction in response to a user rotating the rotation plate in a negative rotational direction. Either causes resistance in response to the movement of the rotation plate to be caused in either the positive rotational direction or the negative rotational direction.

In a second embodiment, the present disclosure provides an exercise machine including: a cord, a frame, a first redirecting apparatus, a user interface, and a moveable weight-bearing member. The frame further includes: a foundation, a first column attached adjacent the foundation and oriented substantially orthogonal to the foundation, a second column attached adjacent the foundation and oriented substantially orthogonal to the foundation, and an upper beam attached adjacent a first end of the first column, attached adjacent a first end of the second column, and oriented substantially orthogonal to the first column and the second column.

The first redirecting apparatus which is attached adjacent the upper beam is useful for redirecting the orientation of a portion of the cord from a first direction to a second direction. A first end of the cord is attached adjacent a location of the redirecting apparatus that is stationary relative to the second column and the upper beam.

The user interface is attached adjacent the second column and includes: a hub, a first arm member, and a first input apparatus. The hub includes a second redirecting apparatus for redirecting the orientation of a portion of the cord from the second direction to a third direction. The first arm member includes a proximal end and a distal end. The proximal end of the first arm member, attached adjacent to and extending from the hub, includes a third redirecting apparatus for redirecting a portion of the cord from the third direction to a fourth direction attached proximate the distal end of the first arm member. The first input apparatus, mounted along the first arm member, includes: a first shaft, a first coupling apparatus, a first rotation plate, a fourth redirecting apparatus, a first engagement interface member, and a first engagement extension. The first coupling apparatus maintains attachment between the first input apparatus and the first arm member. The first shaft is attached adjacent the first coupling apparatus. The first rotation plate is rotatable about a first axis defined by the lengthwise orientation of the first shaft. The fourth redirecting apparatus is attached adjacent a distal end of the first rotation plate. A user can physically engage a user's appendage with the exercise apparatus via the first engagement interface member. The first engagement extension includes a first end and a second end. The first end of the first engagement extension is attached adjacent a second end of the first shaft, the second end of the first engagement extension is attached adjacent the first engagement interface member.

The movable weight-bearing member, attached adjacent the portion of the cord oriented in the first direction, moves in response to the fourth redirecting apparatus forcing the portion of the cord oriented in the third direction to deviate from the third direction in response to a user rotating the first rotation plate in a positive rotational direction. Alternatively, the movable weight-bearing member moves in response to the fourth redirecting apparatus forcing the portion of the cord oriented in the fourth direction to deviate from the fourth direction in response to a user rotating the first rotation plate in a negative rotational direction. Either causes resistance in response to the movement of the rotation plate to be caused in either the positive rotational direction or the negative rotational direction.

In one aspect of the present disclosure, the user interface is movably attached adjacent the second column wherein the user interface can be repositioned along the length of the second column.

In a preferred embodiment, the exercise apparatus of the present disclosure further includes a ballast apparatus. The ballast apparatus includes a counterweight, a ballast cord, and a ballast cord redirecting apparatus. The ballast cord includes a first end and a second end, wherein the first end of the ballast cord is attached adjacent the counterweight and the second end of the ballast cord is attached adjacent the user interface. The ballast cord redirecting apparatus is attached adjacent a first portion of the ballast cord oriented in a primary direction and a second portion of the ballast cord oriented in a secondary direction, whereby the ballast apparatus counters the weight of the user interface so that a user can more easily manipulate the user interface along the second column.

In another aspect of the present disclosure, the first input apparatus is movably mounted along the first arm member wherein the first input apparatus can be selectively fixedly positioned in different locations along the first arm member. In another aspect of the present disclosure, the first shaft is rotatably attached adjacent the first coupling apparatus.

In another aspect of the present disclosure, the first end of the first engagement extension is rotatably attached adjacent a second end of the first shaft. In yet another aspect of the present disclosure, the first engagement extension further includes a first portion and a second portion wherein the first portion of the first engagement extension is oriented at an angle ranging from about 60 degrees to about 120 degrees relative to the second portion of the first engagement extension.

In another aspect of the present disclosure, the cord includes a plurality of shorter cords attached adjacent one another.

In another aspect of the present disclosure, the first coupling apparatus further includes a first pair of redirecting members, wherein the coupling apparatus is configured such that motion of the fourth redirecting apparatus can include motion between the first pair of redirecting members, depending on the amount of force exerted by a user on the first engagement interface member of the exercise machine. In yet another aspect of the present disclosure, the first coupling apparatus further includes a second pair of redirecting members, wherein the coupling apparatus is configured such that motion of the fourth redirecting apparatus can include motion between the second pair of redirecting members, depending on the amount of force exerted by a user on the first engagement interface member of the exercise machine.

In another embodiment, the exercise machine of the present disclosure further includes a fifth redirecting apparatus attached adjacent the upper beam, the fifth redirecting apparatus for redirecting the orientation of a portion of the cord from a fifth direction to a sixth direction, wherein a second end of the cord is attached adjacent a location of the apparatus that is stationary relative to the second column, the upper beam and/or the foundation.

Additionally, the user interface further includes a hub having a sixth redirecting for redirecting the orientation of a portion of the cord from the sixth direction to a seventh direction, a second arm member, and a second input apparatus. The second arm member, attached adjacent to and extending from the hub, includes a seventh redirecting apparatus attached proximate a distal end of the second arm member. The seventh redirecting apparatus is useful for redirecting a portion of the cord from the seventh direction to an eighth direction. The second input apparatus includes a second shaft, a second coupling apparatus, a second rotation plate, an eighth redirecting apparatus attached adjacent a distal end of the second rotation plate, a second engagement interface member, and a second engagement extension. The second coupling apparatus maintains attachment between the second input apparatus and the second arm member. Also, the second shaft is attached adjacent the second coupling apparatus. The second rotation plate is rotatable about a second axis defined by the lengthwise orientation of the second shaft. The second engagement interface member provides a way for a user to physically engage a user's appendage with the exercise apparatus. The second engagement extension includes a first end and a second end. The first end of the second engagement extension is attached adjacent a second end of the second shaft, and the second end of the second engagement extension is attached adjacent the second engagement interface member.

Furthermore, the movable weight-bearing member includes a ninth redirecting apparatus wherein the ninth redirecting apparatus is attached adjacent the portion of the cord oriented in the first direction and attached adjacent the portion of the cord oriented in the fifth direction. The weight apparatus moves in response to: the fourth redirecting apparatus forcing the portion of the cord oriented in the third direction to deviate from the third direction in response to a user rotating the first rotation plate in a positive rotational direction, the fourth redirecting apparatus forcing the portion of the cord oriented in the fourth direction to deviate from the fourth direction in response to a user rotating the first rotation plate in a negative rotational direction, thereby causing resistance in response to the movement of the first rotation plate in either the positive rotational direction or the negative rotational direction of the first rotation plate, the eighth redirecting apparatus forcing the portion of the cord oriented in the seventh direction to deviate from the seventh direction in response to a user rotating the second rotation plate in a positive rotational direction; or the eighth redirecting apparatus forcing the portion of the cord oriented in the eighth direction to deviate from the eighth direction in response to a user rotating the second rotation plate in a negative rotational direction, thereby causing resistance in response to the movement of the second rotation plate in either the positive rotational direction or the negative rotational direction of the second rotation plate.

In a preferred embodiment, the hub further includes a tenth redirecting apparatus configured for redirecting the orientation of a portion of the cord from the fourth direction to a ninth direction toward a lower portion of the second column, and an eleventh redirecting apparatus configured for redirecting the orientation of a portion of the cord from the eighth direction to a tenth direction toward a lower portion of the second column. Additionally, the user interface is movably attached adjacent the second column wherein the user interface can be repositioned along the length of the second column. In a more preferred embodiment, the user interface is movably attached adjacent to the second column wherein the user interface can be repositioned along the length of the second column.

In yet another more preferred embodiment, the exercise apparatus further includes a ballast apparatus useful for countering the weight of the user interface so that a user can more easily manipulate the user interface along the second column. The ballast apparatus includes a counterweight; a ballast cord including a first end and a second end, where the first end of the ballast cord attached adjacent the counterweight and the second end of the ballast cord attached adjacent the user interface; and a ballast cord redirecting apparatus attached adjacent a first portion of the ballast cord oriented in a primary direction and a second portion of the ballast cord oriented in a secondary direction.

In another aspect of the present disclosure, the first input apparatus is movably mounted along the first arm member wherein the first input apparatus can be selectively fixedly positioned in different locations along the first arm member. Also the second input apparatus is movably mounted along the second arm member wherein the second input apparatus can be selectively fixedly positioned in different locations along the second arm member.

In another aspect of the present disclosure, the first shaft is rotatably attached adjacent the first coupling apparatus, and the second shaft is rotatably attached adjacent the second coupling apparatus.

In another aspect of the present disclosure, the first end of the first engagement extension is rotatably attached adjacent a second end of the first shaft, and the first end of the second engagement extension is rotatably attached adjacent a second end of the second shaft. In a preferred embodiment, the first engagement extension further includes a first portion and a second portion wherein the first portion of the first engagement extension is oriented at an angle ranging from about 60 degrees to about 120 degrees relative to the second portion of the first engagement extension, and wherein the second engagement extension further includes a first portion and a second portion wherein the first portion of the second engagement extension is oriented at an angle ranging from about 60 degrees to about 120 degrees relative to the second portion of the second engagement extension.

In another aspect of the present disclosure, the first coupling apparatus further includes a first pair of redirecting members and a second pair of redirecting members, wherein the coupling apparatus is configured such that motion of the fourth redirecting apparatus can include motion between the first pair of redirecting members and the second pair of redirecting members depending on the amount of force exerted by a user on the first engagement interface member of the exercise machine; and wherein the second coupling apparatus further includes a third pair of redirecting members and a fourth pair of redirecting members, wherein the coupling apparatus is configured such that motion of the eighth redirecting apparatus can include motion between the third pair of redirecting members and the fourth pair of redirecting members depending on the amount of force exerted by a user on the second engagement interface member of the exercise machine.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Figure 1:
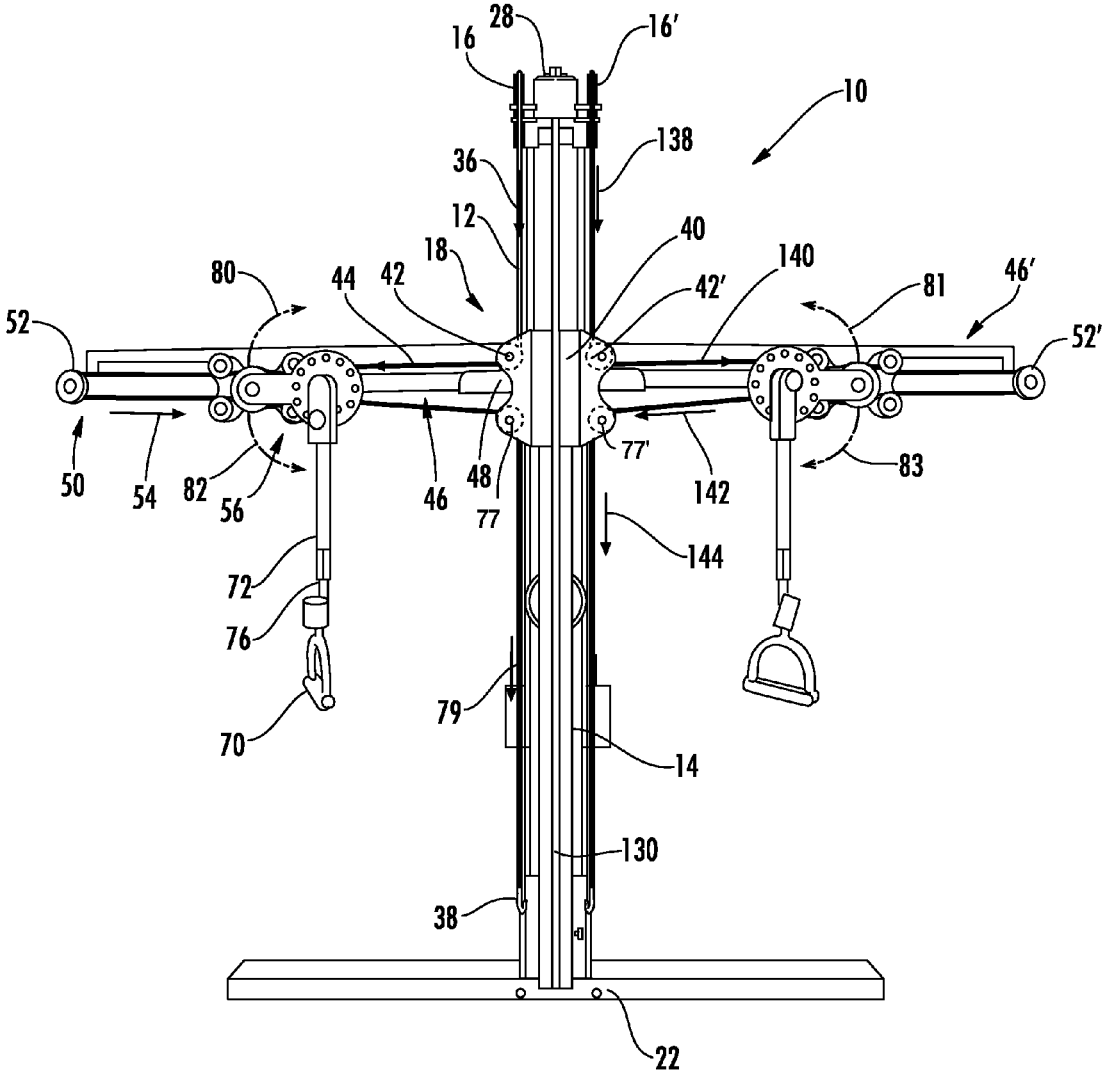
FIG. 1 shows a somewhat schematic front view of an exemplary exercise apparatus as described herein.

Embodiments of the disclosed apparatus include features such as those displayed in FIGS. 1-7. FIGS. 1-7 show an exercise apparatus 10 including a cord 12, a frame 14, a first redirecting apparatus 16, a user interface 18, and a movable weight bearing member 20. The frame 14 includes a foundation 22, a first column 24 attached adjacent the foundation 22 and oriented substantially orthogonal to the foundation 22, a second column 26 attached adjacent the foundation 22 and oriented substantially orthogonal to the foundation 22, and an upper beam 28 attached adjacent a first end of the first column 30, attached adjacent a first end of the second column 32, and oriented substantially orthogonal to the first column 24 and the second column 26. The various parts of the frame 14 can be attached by welding, bolts, screws, and other means known to persons having ordinary skill in the art. The first redirecting apparatus 16 is attached adjacent the upper beam 28 and redirects the orientation of a portion of the cord 12 from a first direction 34 to a second direction 36, wherein a first end of the cord 38 is attached adjacent a location of the exercise apparatus 10 that is stationary relative to the second column 26 and the upper beam 28.

The user interface 18 is attached adjacent the second column 26 and includes a hub 40 including a second redirecting apparatus 42. The second redirecting apparatus 42 redirects the orientation of a portion of the cord 12 from the second direction 36 to a third direction 44. The user interface 18 also includes a first arm member 46 including a proximal end 48 and a distal end 50, the proximal end 48 of the first arm member attached adjacent to and extending from the hub 40. The first arm member 46 includes a third redirecting apparatus 52 attached proximate the distal end 50 of the first arm member 46, the third redirecting apparatus 52 for redirecting a portion of the cord 12 from the third direction 44 to a fourth direction 54. The user interface 18 further includes a first input apparatus 56 mounted along the first arm member 46. The first input apparatus 56 includes a first shaft 58 and a first coupling apparatus 60 that maintains attachment between the first input apparatus 56 and the first arm member 46. The first shaft 58 is attached adjacent the first coupling apparatus 60. The first input apparatus 56 further includes a first rotation plate 62 rotatable about a first axis 64 defined by the lengthwise orientation of the first shaft 58; a fourth redirecting apparatus 66 attached adjacent a distal end 68 of the first rotation plate 62; a first engagement interface member 70 for a user to engage one of his or her appendages with the exercise apparatus 10; and a first engagement extension 72 including a first end 74 and a second end 76, the first end 74 of the first engagement extension 72 attached adjacent a second end 78 of the first shaft 58, the second end 76 of the first engagement extension 72 attached adjacent the first engagement interface member 70. The first engagement extension 72 can be in the form of, for example, a rod, a chain, a cord (elastic or non-elastic), a band (elastic or non-elastic), or other object providing tensile strength and/or compressive strength between the first end 74 and the second end 76 of the engagement extension. A fifth redirecting apparatus 77, preferably included as a portion of the hub 40, redirects the cord from the fourth direction 54 to a fifth direction 79.

The movable weight bearing member 20 is engaged with the cord 12 adjacent the portion of the cord 12 oriented in the first direction 34, wherein the weight bearing member 20 moves in response to the fourth redirecting apparatus 66 forcing the portion of the cord 12 oriented in the third direction 44 to deviate from the third direction 44 in response to a user rotating the first rotation plate 62 in a first pattern 80, or the fourth redirecting apparatus 66 forcing the portion of the cord 12 oriented in the fourth direction 54 to deviate from the fourth direction 54 in response to a user rotating the first rotation plate 62 in a second pattern 82, thereby causing resistance to a user in response to the movement of the first rotation plate 62 in either the first pattern 80 direction or the second pattern 82 direction.

Preferably, the user interface 18 is movably attached along the second column 26 so that the user interface 18 can be repositioned along at least a portion of the length of the second column 26. To facilitate movement of the user interface 18, a ballast apparatus 84 is preferably included, the ballast apparatus 84 including a counterweight 86, a ballast line 88, and a ballast line redirecting apparatus 90. The ballast line 88 includes a first end 92 and a second end 94, and the first end 92 of the ballast line 88 is attached adjacent the counterweight 86 and the second end 94 of the ballast line 88 is attached adjacent the user interface 18. The ballast line redirecting apparatus 90 is attached adjacent a first portion of the ballast line 88 oriented in a primary direction 96 and a second portion of the ballast line 88 oriented in a secondary direction 98. In the embodiment shown in FIGS. 1-7, the user interface 18 is selectively fixedly positioned along the second column 26 by, for example, one or more push pins 100 configured for removable insertion into a plurality of apertures 102 along the second column 26. Although push pins are given as an example here, other devices known to persons having ordinary skill in the art for removably fixedly attaching the user interface 18 to the second column 26 are contemplated to accomplish the same function as described in this disclosure.

In a preferred embodiment the first input apparatus 56 is movably mounted along the first arm member 46 so that the first input apparatus 56 can be selectively fixedly positioned in different locations along the first arm member 46. In the embodiment shown in FIGS. 1-7, this selective positioning is accomplished, for example, by one or more push pins 104 configured for removable insertion into a plurality of apertures 106 along the first arm member 46. Although push pins are given as an example here, other devices known to persons having ordinary skill in the art for removably fixedly attaching the first input apparatus 56 to the first arm member 46 are contemplated to accomplish the same function as described in this disclosure.

Figure 8:
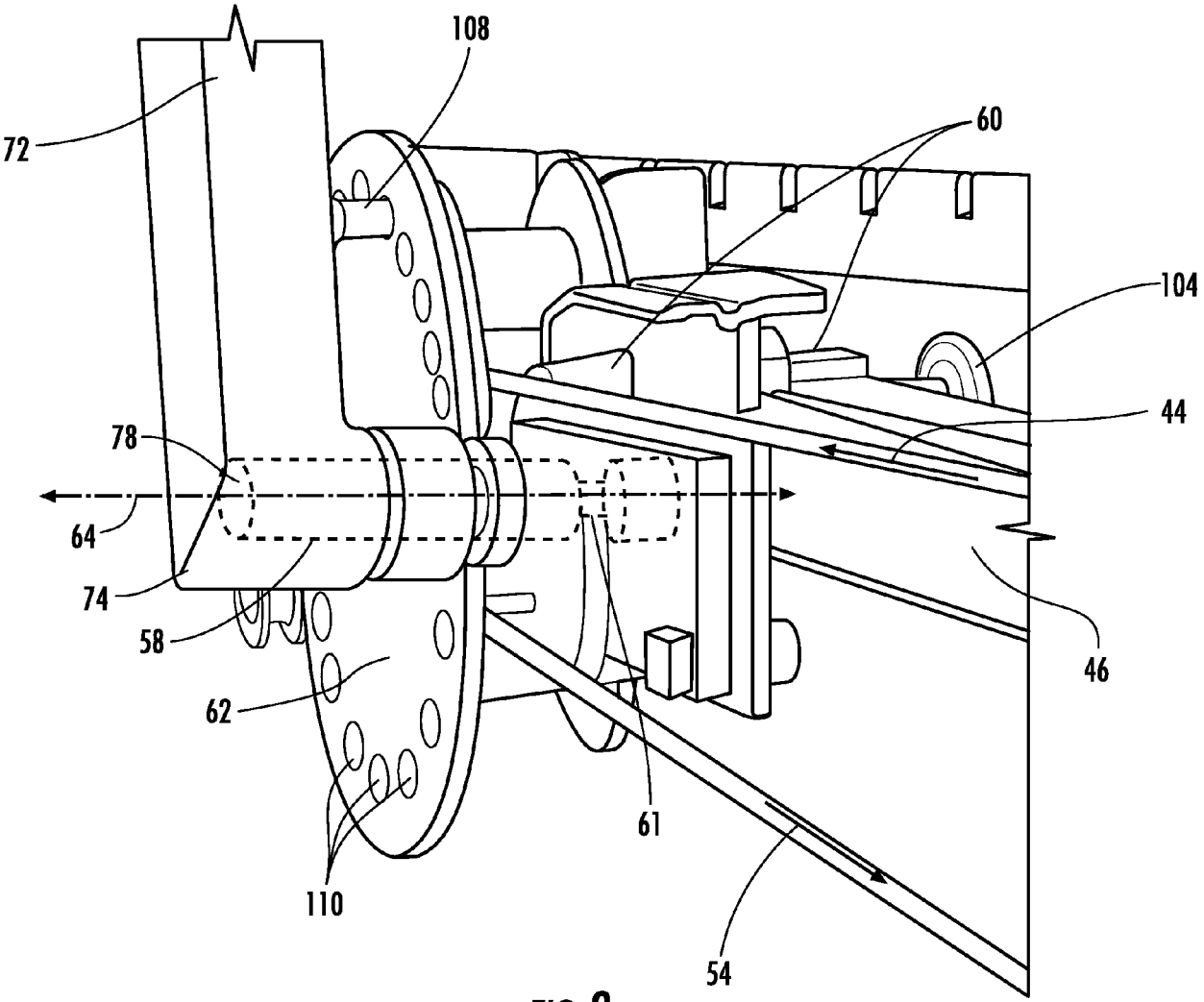
FIG. 8 shows a somewhat schematic cut away view of an exemplary input apparatus wherein a shaft is rotatably attached to a coupling apparatus, part of an exemplary exercise apparatus as described herein.
Figure 9:
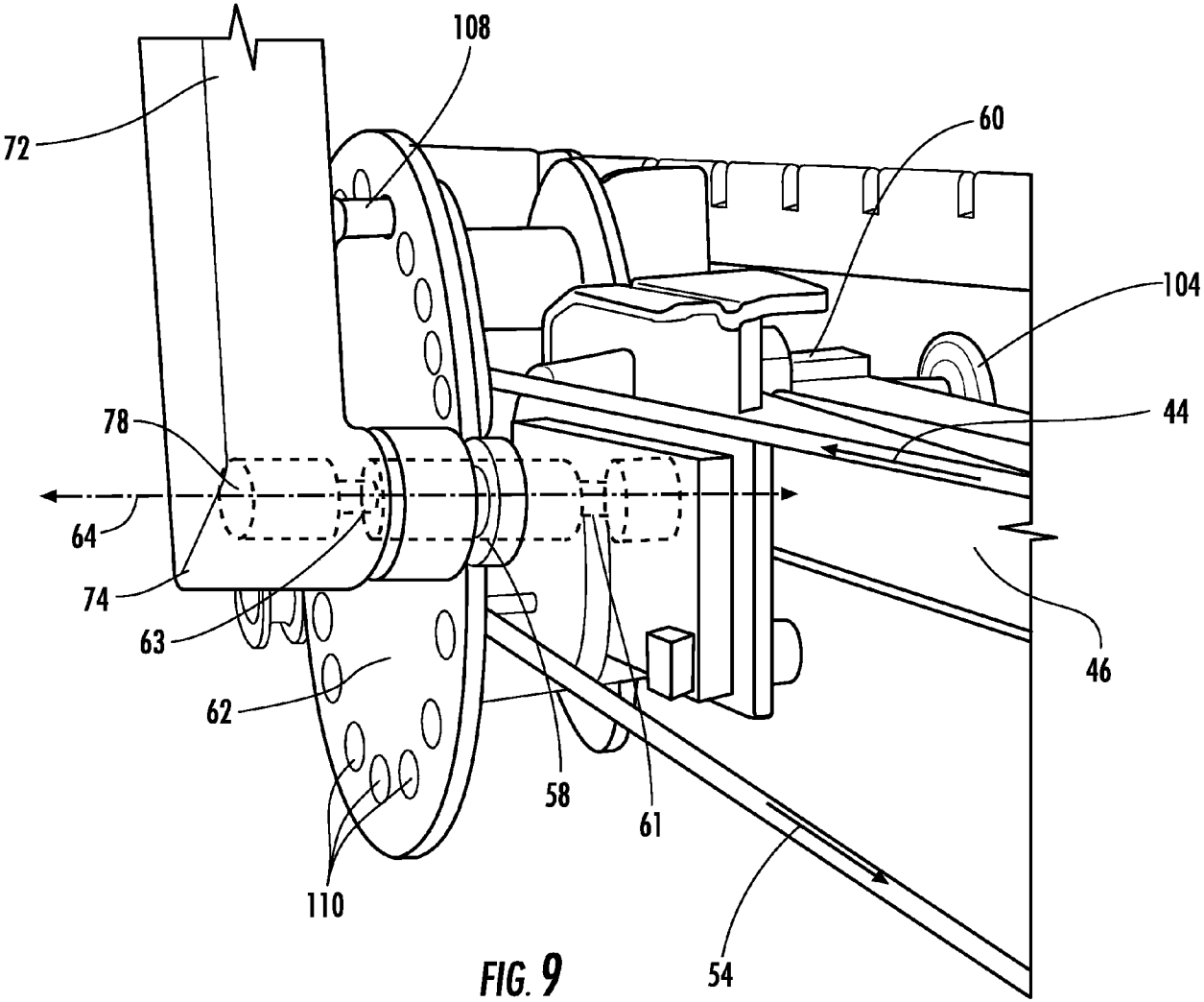
FIG. 9 shows a somewhat schematic cut away view of an exemplary input apparatus wherein an engagement extension is rotatably attached to a shaft, part of an exemplary exercise apparatus as described herein.

In a preferred embodiment, the first shaft 58 is rotatably attached adjacent the first coupling apparatus 60 via, for example, a first groove 61 along the shaft (including, e.g., one or more bearings) so that the first shaft 58, the first rotation plate 62, and the attached first engagement extension 72 are free to rotate relative to the first coupling apparatus 60 as shown, for example in FIG. 8 and FIG. 9. In this example, the first engagement extension 72 can be fixedly attached adjacent the first shaft 58. In an alternative example, the first engagement extension 72 is rotatably attached adjacent the first shaft 58 so that the first engagement extension 72 is free to rotate relative to the first shaft 58 as shown in FIG. 9 along, for example, a second groove 63. In this particular example, the first engagement extension 72 is selectively and removably attached to the first rotation plate 62, for example, by one or more push pins configured for removable insertion into a plurality of apertures along the first rotation plate 62 as shown in FIGS. 1-7. In this way, the engagement extension 72 can be repositioned at different angles relative to the fourth redirecting apparatus 66 of the first rotation plate 62, thereby changing the manner in which weight resistance is encountered by a user acting on the first rotation plate 62. Although one or more push pins are specifically mentioned with regard to these examples, other devices known to persons having ordinary skill in the art for removably fixedly attaching the first engagement extension 72 to the first rotation plate 62 are contemplated to accomplish the same function as described in this disclosure. Similarly, although one or more grooves are specifically mentioned with regard to these examples, other devices known to persons having ordinary skill in the art for (1) attaching the first shaft 58 adjacent the first coupling apparatus 60 wherein the first shaft 58 is free to rotate relative to the first coupling apparatus 60 or (2) attaching the first shaft 58 adjacent the first engagement extension 72 wherein the first engagement extension 72 is free to rotate relative to the shaft 58 are contemplated to accomplish the same functions as described in this disclosure.

Figure 2:
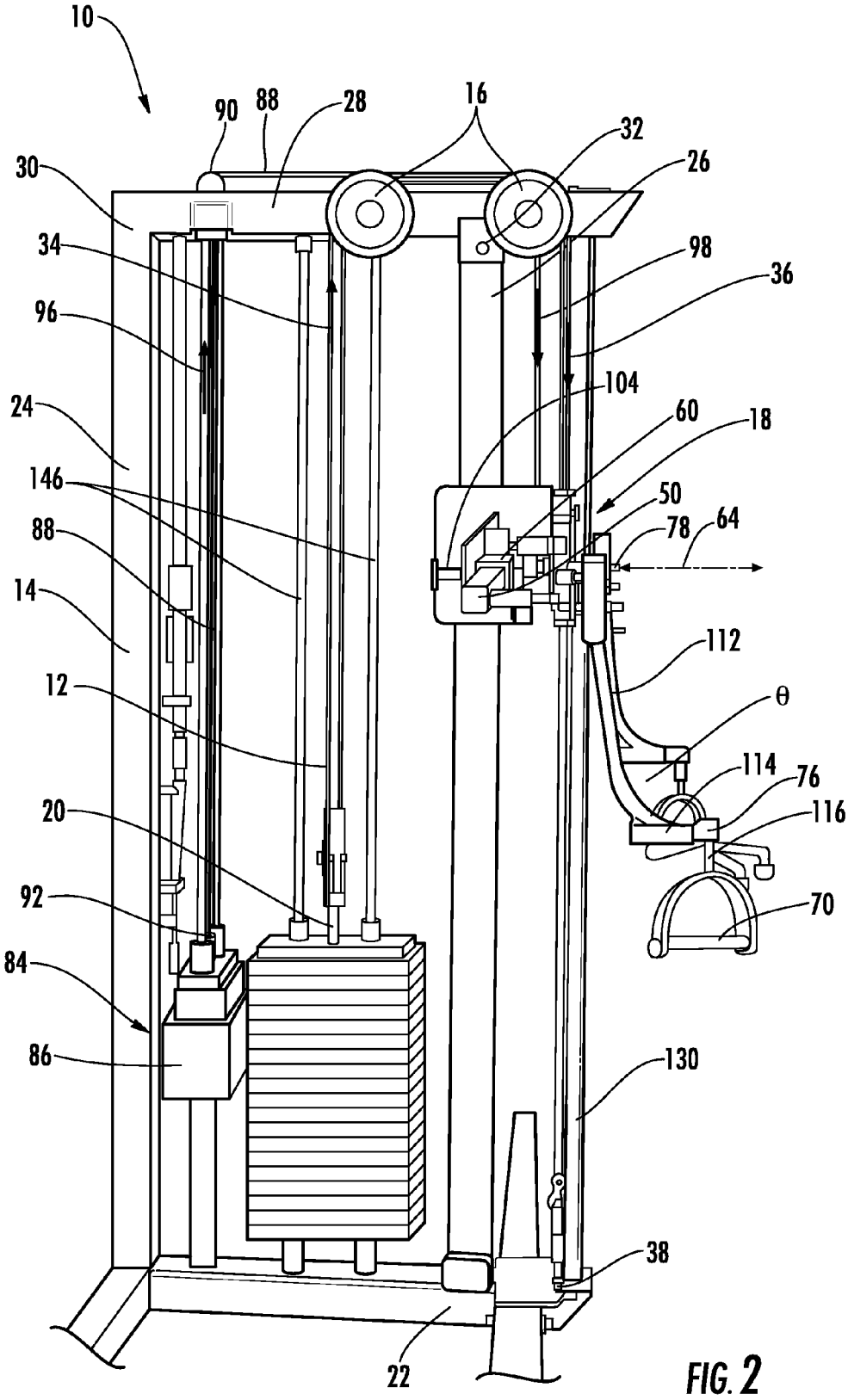
FIG. 2 shows a somewhat schematic side view of an exemplary exercise apparatus as described herein.
Figure 3:
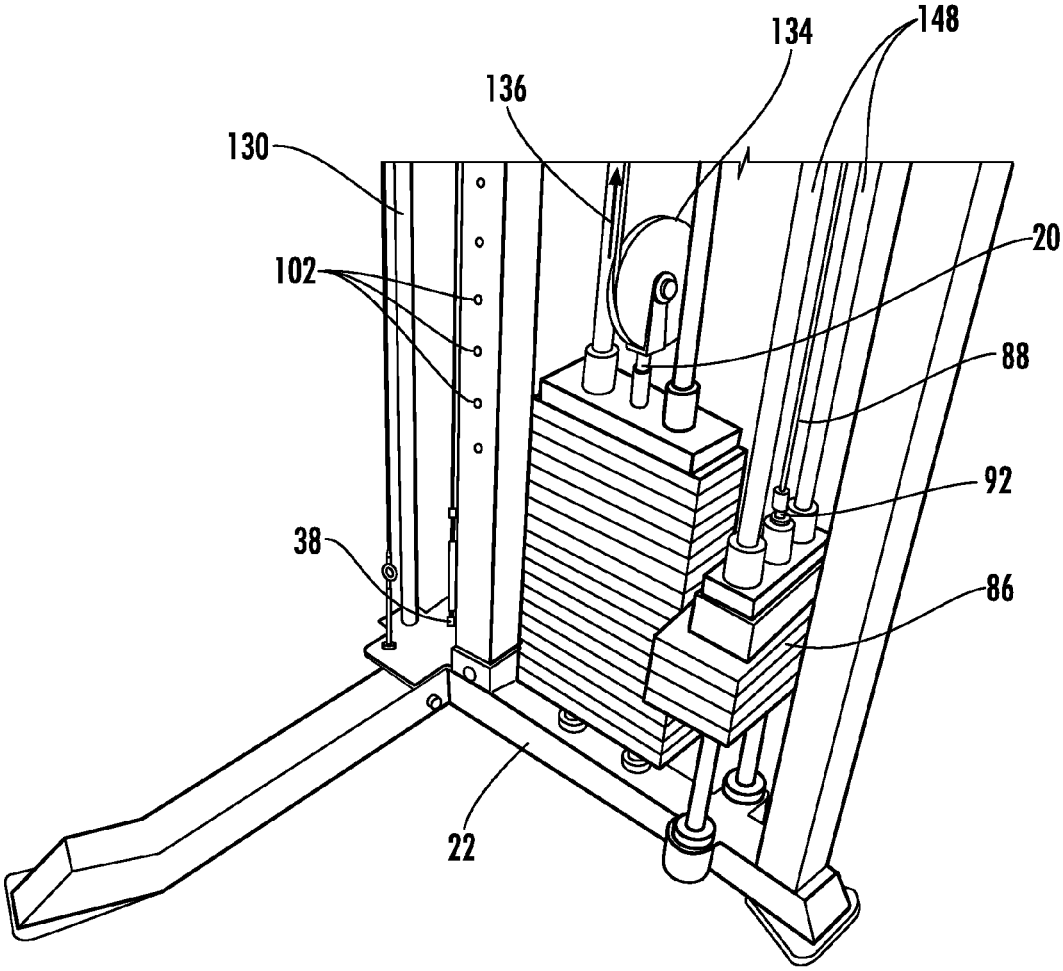
FIG. 3 shows a somewhat schematic perspective view toward the foundation of an exemplary exercise apparatus as described herein.
Figure 4:
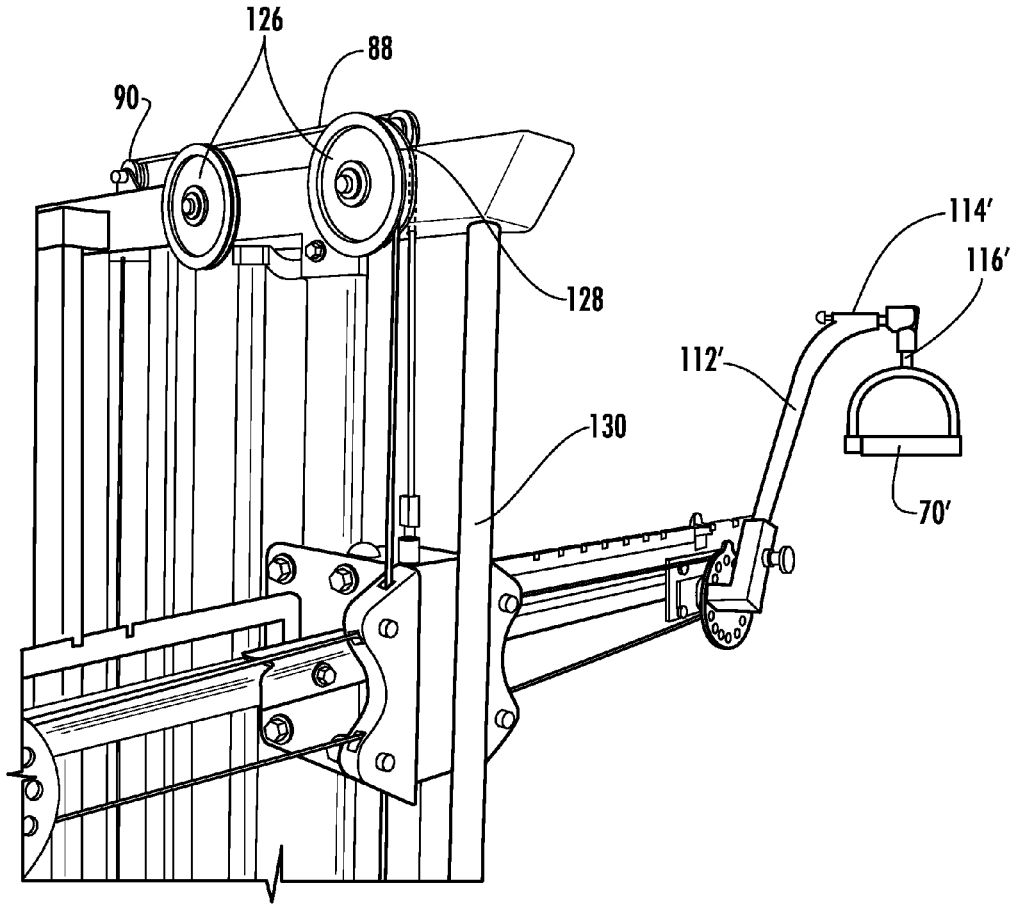
FIG. 4 shows a somewhat schematic perspective view of the upper half of an exemplary exercise apparatus as described herein.
Figure 5:
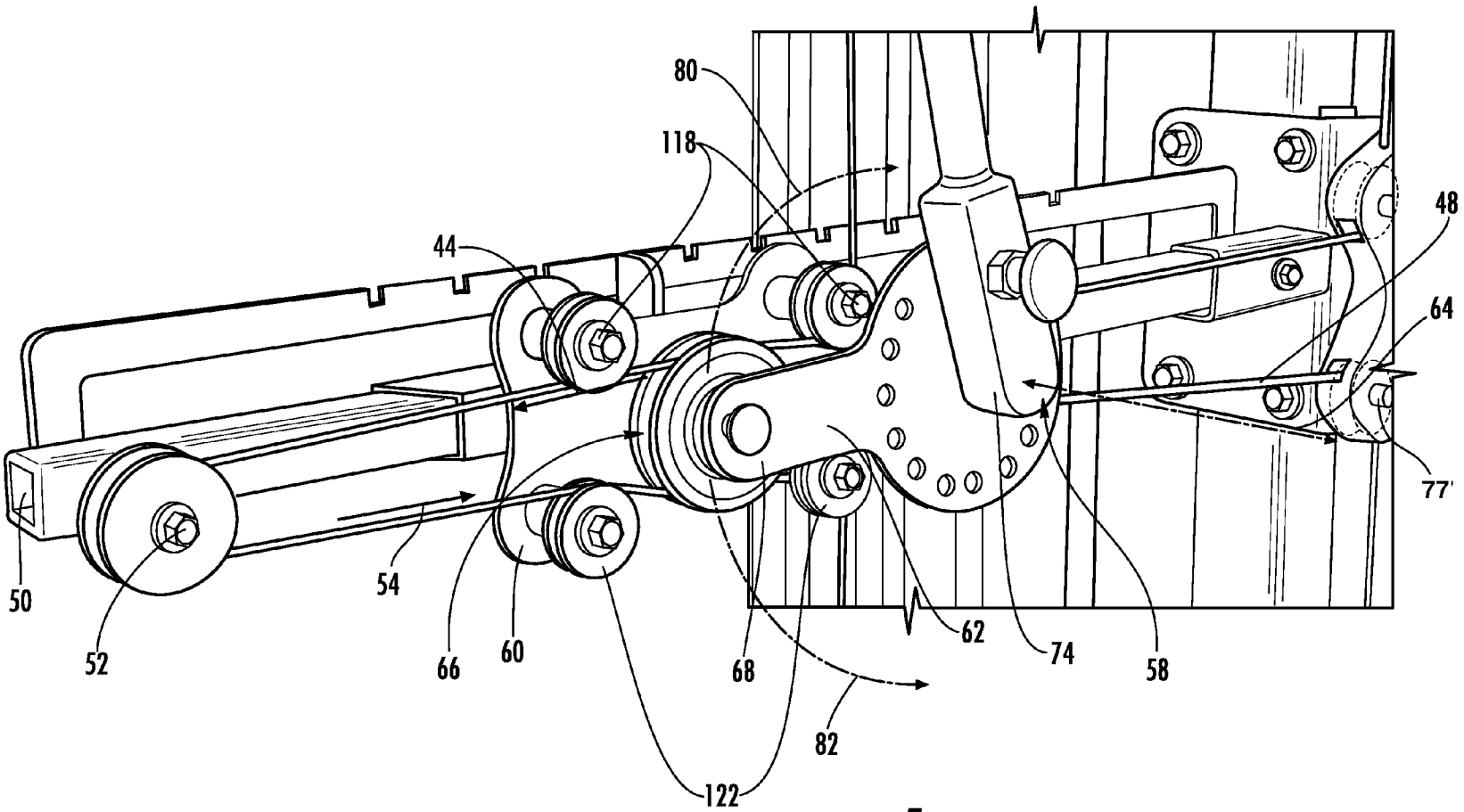
FIG. 5 shows a somewhat schematic perspective close-up view of a first arm member of an exemplary exercise apparatus as described herein.
Figure 6:
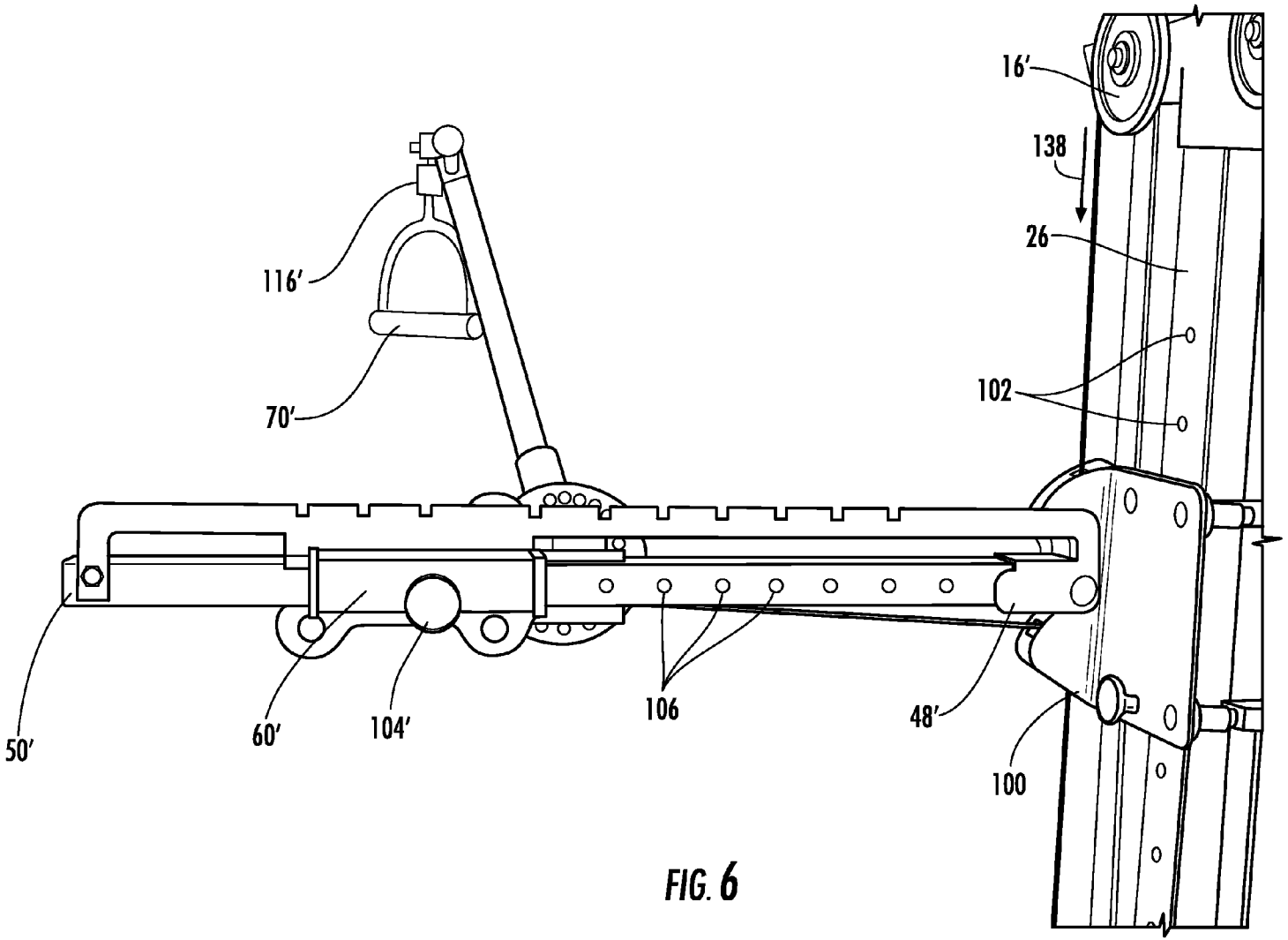
FIG. 6 shows a somewhat schematic perspective view from the rear of one side of an exemplary exercise apparatus as described herein.
Figure 7:
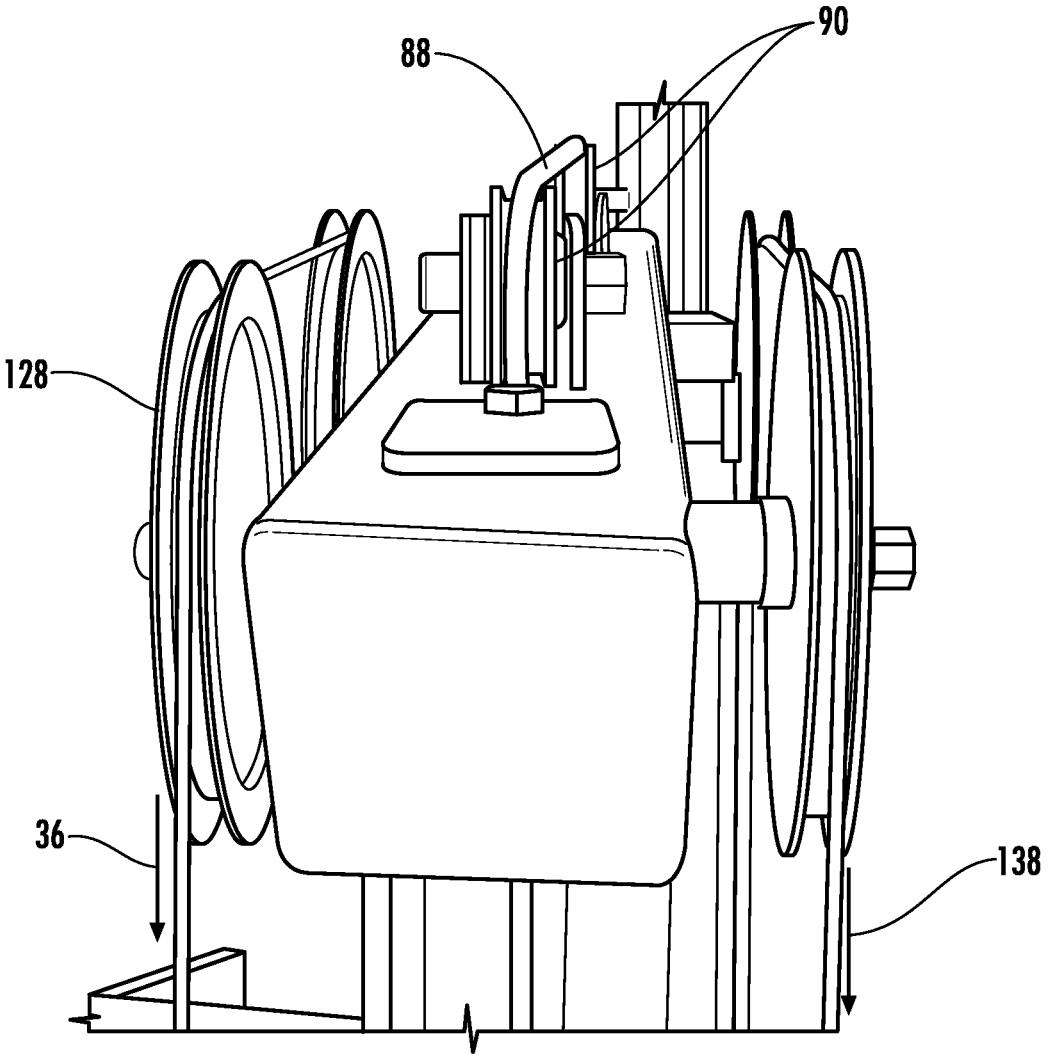
FIG. 7 shows a somewhat schematic close-up front view of a top portion of an exemplary exercise apparatus as described herein.

In the example(s) shown in FIGS. 1-7, the first engagement extension 72 includes a first rod-like portion 112 and a second rod-like portion 114 wherein the first portion 112 of the first engagement extension 72 is attached at an angle θ ranging from about 60 degrees to about 120 degrees relative to the second portion 114 of the first engagement extension 72 as shown in FIG. 2. In this and other embodiments, the first engagement interface member 70 is preferably movably attached adjacent the first engagement extension 72. For example, as shown in FIGS. 2, 4, and 6, the first engagement interface member 70 can be attached adjacent the first engagement extension 72 by a ball and socket joint 116, thereby providing substantial freedom of motion for a user.

In the example shown in FIG. 5, the first coupling apparatus 60 includes a first pair of redirecting members 118. In this embodiment, the first coupling apparatus 60 is configured such that motion of the fourth redirecting apparatus 66 can include motion between the first pair of redirecting members 118, depending on the amount of force exerted by a user on the first engagement interface member 70 of the exercise apparatus 10. In a related example, the first coupling apparatus 60 includes a second pair of redirecting members 122. In this example, the first coupling apparatus 60 is configured such that motion of the fourth redirecting apparatus 66 can include motion between the second pair of redirecting members 122, depending on the amount of force exerted by a user on the first engagement interface member 70 of the exercise apparatus 10.

The first redirecting apparatus 16 preferably includes two wheels 126, each including a concave rim or groove 128. In various embodiments, the various redirecting apparatuses and redirecting members described herein preferably include, for example, one or more wheels for redirecting the cord 12 as described herein. Such wheels are preferably rotatable about a fixed axis. Although wheels are specifically mentioned in various examples described and shown herein, other devices known to person having ordinary skill in the art for engaging or otherwise attached the cord 12 to another object are contemplated to accomplish the same function as described in this disclosure.

Preferably, embodiments of this disclosure include a protective barrier 130. The protective barrier 130 may be, for example, in the form of a pole as shown in FIGS. 2-4 to shield a user's body from unintentional contact with the hub 40.

Figure 10:
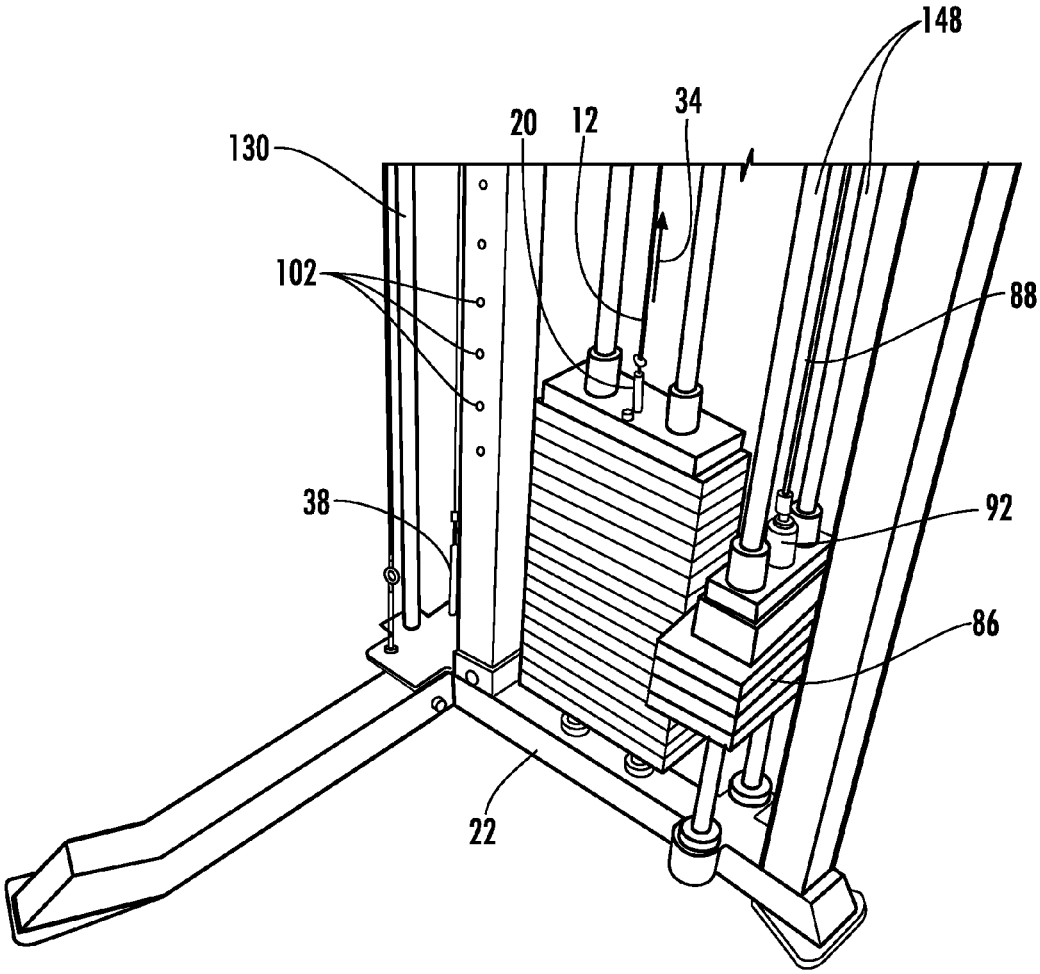
FIG. 10 shows a somewhat schematic close-up perspective view of an exemplary exercise apparatus as described herein, such view showing the attachment of a cord to a weight bearing member.

In one embodiment of the disclosure, a second end of the cord 132 is attached adjacent the movable weight bearing member 20 as shown, for example, in FIG. 10. However, embodiments of this disclosure are preferably configured for exercises in which a user may use both hands (i.e., using the user's first hand to grab the first engagement interface member 70 and the user's second hand to grab a second engagement interface member 70'). To accomplish this preferred modality, many preferred embodiments of the exercise apparatus include duplicate features arranged on opposing sides of the second column 26. For example, as shown in FIG. 1, the exercise apparatus 10 further includes a second arm member 46' including substantially the same features as the first arm member 46'. For clarity, these opposed, duplicate features are indicated by the same numeral as the features described above, but the opposed, duplicate features are differentiated by a prime indicator (i.e., "'") such as, for example, a sixth redirecting apparatus 16', a seventh redirecting apparatus 42', a second arm member 46', a proximal end of the second arm member 48', a distal end of the second arm member 50', an eighth redirecting apparatus 52', a second input apparatus 56', a second coupling apparatus 60', a second rotation plate 62', a ninth redirecting apparatus 66', and a second engagement extension 72', as well as a third pattern 81 and a fourth pattern 83. Instead of the second end of the cord 132 being attached adjacent the movable weight bearing member 20, the cord 12 is longer and extends partially around a weight wheel 134 attached adjacent the movable weight bearing member 20. The cord 12 further extends in a sixth direction 136, encounters the sixth redirecting apparatus 16' and then extends in a seventh direction 138, encounters the seventh redirecting apparatus 42' and then extends in an eighth direction 140, encounters the eighth redirecting apparatus 52' and then extends in a ninth direction 142, encounters the ninth redirecting apparatus 66' and then extends in a tenth direction 144, and is then attached adjacent a location of the exercise apparatus 10 that is stationary relative to the second column 26 and the upper beam 28, preferably near or at the location where the first end of the cord 38 is attached.

In certain embodiments, the weight bearing member 20 and any built-in, attached, and/or stacked-on weight associated therewith are preferably stabilized by one or more stabilization members 146. Similarly, the counterweight 86 is preferably stabilized by one or more ballast stabilizers 148.

Figure 11:
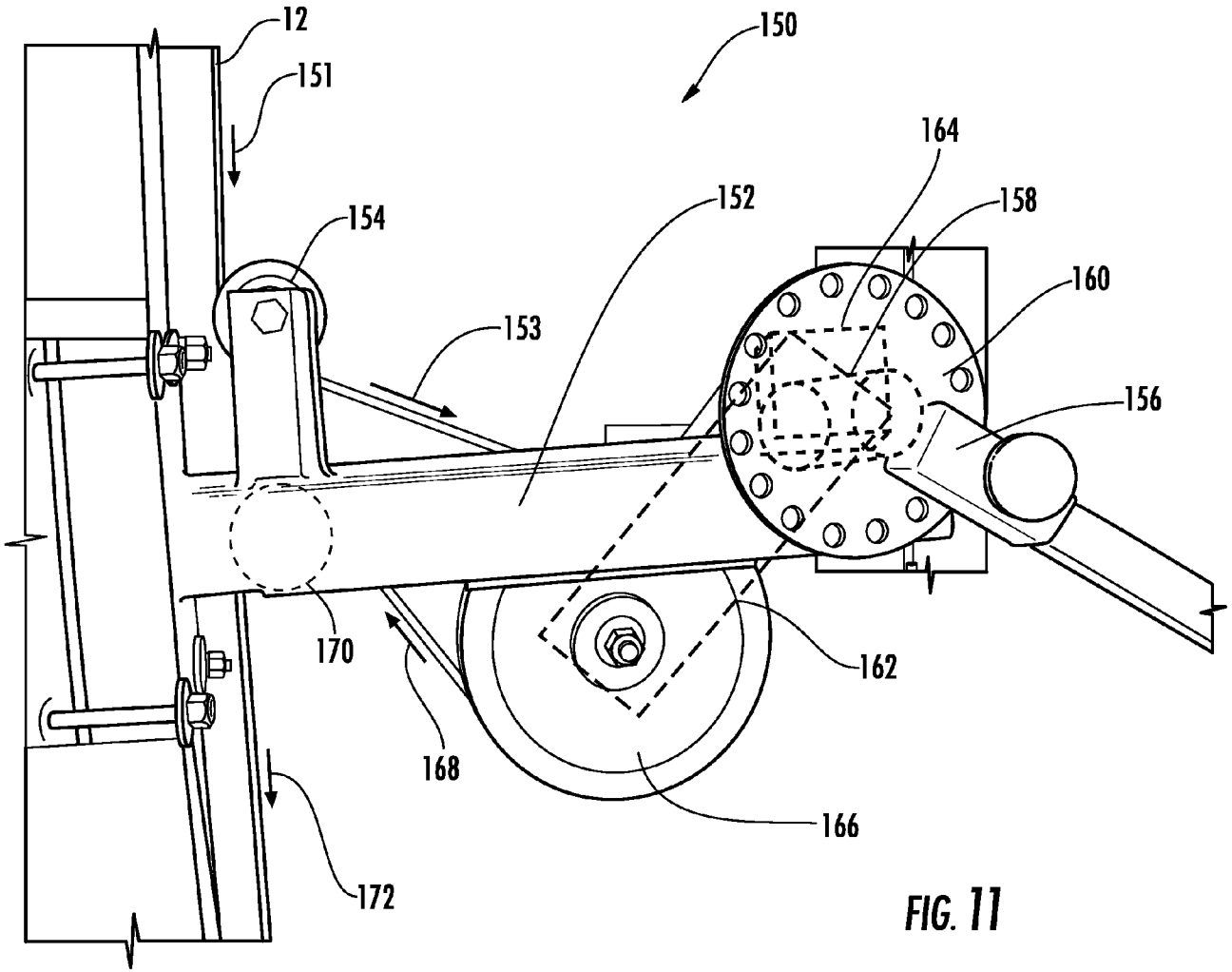
FIG. 11 shows a somewhat schematic perspective view of a portion of an exemplary exercise apparatus as described herein.

Another variation of the exercise apparatus 10 is shown in FIG. 11, showing a close-up view of a user interface 150, the cord 12, and an arm member 152. In this variation, a second redirecting apparatus 154 is attached adjacent the arm member 152 instead of a hub as in the examples discussed above, and the second redirecting apparatus 154 redirects the cord 12 from a second direction 151 to a third direction 153. Also, in this variation, the arm member includes an input apparatus 156 rotatably attached adjacent a shaft 158, a first rotation plate 160 attached adjacent the shaft 158, and second rotation plate 162 attached adjacent the shaft 158. Although two rotation plates are sown in this variation, one rotation plate can suffice as in previous examples discussed herein. The shaft 158 is configured to rotate along its lengthwise axis because it is movably attached to the arm member 152 via a coupling apparatus 164. Unlike the examples of the exercise apparatus 10 described above, the arm member 152 of the exemplary exercise apparatus shown in FIG. 11 does not include a redirecting apparatus at its distal end. Instead, a redirecting member 166 is attached adjacent the second rotation plate 162. The redirecting member 166 redirects a portion of the cord 12 from an orientation in the third direction 153 to an orientation in a fourth direction 168. A third redirecting apparatus 170 is attached adjacent the arm member 152 and redirects the cord from an orientation in the fourth direction to an orientation in a fifth direction 172. Other features of this variation are preferably similar to the examples of the exercise apparatus 10 described above.

Most of the various parts of the exercise apparatuses described herein are preferably made of a metal or metal alloy; more preferably, stainless steel, long steel, flat carbon steel, iron, aluminum, titanium, and/or combinations thereof which may or may not include additional trace substances. Other parts of the exercise apparatuses described herein such as, for example, protective layers and end pieces, can be made from one or more plastic and/or rubber materials known to persons having ordinary skill in the art. The cord 12 is preferably made primarily of metal or a metal alloy, and is most preferably made of steel. Alternatively or additionally, the cord 12 may be made of natural fibers, synthetic fibers, metals, metal allows, and combinations thereof. The cord 12 material can include, for example, single braiding, multi-braiding, solid braiding, plaited material, and/or Kernmantle material and may be in the form of a flat band, a curved cross section, a polygonal cross section, or other configuration.

Although the term "cord" as used herein is in the singular form, it is to be understood that such term may include a plurality of sub-cords attached together in some manner wherein the plurality of sub-cords can include different tensile strength characteristics (e.g., different respective elasticities). The term "cord" is defined broadly herein to include strap, rope, belt, line, and other similar elongate flexible structures having flexible rope-like qualities.

Because of the flexibility of the embodiments and examples described herein and the various contemplated embodiments and examples, any number of different types of resistance-type exercises could be accomplished using embodiments of the invention. For example, a user could use one or both arms to engage the first interface member 70 in the form of a handle (or the first engagement interface member 70 and the second engagement interface member 70' in the form of handles) and perform a pulling and/or pushing exercise. Similarly, a user could use one or both legs to engage the first engagement interface member 70 in the form of a foot holder (or the first engagement interface member 70 and the second engagement interface member 70' in the form of foot holders) and perform a pulling and/or pushing exercise. Because preferred embodiments of the exercise apparatus allow for setting and resetting the relative position(s) of the first input apparatus 56 (and the second input apparatus 56', if applicable) as well as the user interface 18, the vertical and horizontal zone in space where a user can experience resistance training is significantly broad and encompasses exercises that provide resistance training to virtually all muscle groups of the human body.

The previously described embodiments of the present disclosure have many advantages, including providing resistance training in a single engagement zone (e.g., using one hand, one foot, or other appendage at one engagement interface member) or multiple engagement zones (e.g., using a first appendage and a second appendage, each appendage at different engagement interface members). The freedom of motion provided by embodiments of the exercise apparatus allow a user to twist his or her torso and/or body "core" when performing resistance exercises in multiple engagement zones. Such twisting provides exercise training to a user's body core in addition to muscle groups associated with the appendages engaged with the engagement interface members. Embodiments of the exercise apparatus can be used from a standing position, sitting position, kneeling position, laying position (on a bench or on a floor surface), or any other conceivable body position relative to the applicable exercise apparatus.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

Any element in a claim that does not explicitly state "means for" performing a specified function, or "step for" performing a specific function, is not to be interpreted as a "means" or "step" clause as specified in 35 U.S.C. §112, ¶6. In particular, the use of "step of" in the claims herein is not intended to invoke the provisions of 35 U.S.C. §112, ¶6.

What is claimed is:

1. An exercise machine comprising:

a cord;

a frame including a base, a first column attached adjacent the base and oriented substantially orthogonal to the base, a second column attached adjacent the base and oriented substantially orthogonal to the base, and an upper beam attached adjacent a first end of the first column, attached adjacent a first end of the second column, and oriented substantially orthogonal to the first column and the second column;

a first redirecting apparatus attached adjacent the upper beam, the first redirecting apparatus for redirecting the orientation of a portion of the cord from a first direction to a second direction, wherein a first end of the cord is attached adjacent a location of the apparatus that is stationary relative to the second column and the upper beam;

a user interface attached adjacent the second column, the user interface including:

a hub;

an arm member including a proximal end and a distal end, the proximal end of the arm member attached adjacent to and extending from the hub, wherein a second redirecting apparatus is attached adjacent the arm member, the second redirecting apparatus for redirecting the orientation of a portion of the cord from the second direction to a third direction; and an input apparatus mounted along the arm member, the input apparatus including:

a shaft;

a coupling apparatus wherein the coupling apparatus maintains attachment between the input apparatus and the arm member, and wherein the shaft is attached adjacent the coupling apparatus;

a rotation plate rotatable about an axis defined by the lengthwise orientation of the shaft;

a redirecting member attached adjacent a distal end of the rotation plate wherein the cord is oriented partially about the redirecting member such that when the exercise apparatus is not in use, the cord approaches the redirecting member in an orientation in the third direction and the cord exits the redirecting member in an orientation in a fourth direction;

an engagement interface member wherein a user can physically engage a user's appendage with the exercise apparatus via the engagement interface member; and an engagement extension including a first end and a second end, the first end of the engagement extension attached adjacent a second end of the shaft, the second end of the engagement extension attached adjacent the engagement interface member; and a movable weight bearing member attached adjacent the portion of the cord oriented in the first direction, wherein the weight bearing apparatus moves in response to the redirecting member forcing the portion of the cord oriented in the third direction to deviate from the third direction in response to a user rotating the rotation plate in a positive rotational direction, or the redirecting member forcing the portion of the cord oriented in the fourth direction to deviate from the fourth direction in response to a user rotating the rotation plate in a negative rotational direction, thereby causing resistance in response to the movement of the rotation plate in either the positive rotational direction or the negative rotational direction.

2. An exercise machine comprising:

a cord;

a frame including a base, a first column attached adjacent the base and oriented substantially orthogonal to the base, a second column attached adjacent the base and oriented substantially orthogonal to the base, and an upper beam attached adjacent a first end of the first column, attached adjacent a first end of the second column, and oriented substantially orthogonal to the first column and the second column;

a first redirecting apparatus attached adjacent the upper beam, the first redirecting apparatus for redirecting the orientation of a portion of the cord from a first direction to a second direction, wherein a first end of the cord is attached adjacent a location of the apparatus that is stationary relative to the second column and the upper beam;

a user interface attached adjacent the second column, the user interface including:

a hub including a second redirecting apparatus, the second redirecting apparatus for redirecting the orientation of a portion of the cord from the second direction to a third direction;

a first arm member including a proximal end and a distal end, the proximal end of the first arm member attached adjacent to and extending from the hub, the first arm member including a third redirecting apparatus attached proximate the distal end of the first arm member, the third redirecting apparatus for redirecting a portion of the cord from the third direction to a fourth direction; and a first input apparatus mounted along the first arm member, the first input apparatus including:

a first shaft;

a first coupling apparatus wherein the first coupling apparatus maintains attachment between the first input apparatus and the first arm member, and wherein the first shaft is attached adjacent the first coupling apparatus;

a first rotation plate rotatable about a first axis defined by the lengthwise orientation of the first shaft;

a fourth redirecting apparatus attached adjacent a distal end of the first rotation plate;

a first engagement interface member wherein a user can physically engage a user's appendage with the exercise apparatus via the first engagement interface member; and a first engagement extension including a first end and a second end, the first end of the first engagement extension attached adjacent a second end of the first shaft, the second end of the first engagement extension attached adjacent the first engagement interface member; and a movable weight bearing member attached adjacent the portion of the cord oriented in the first direction, wherein the weight bearing apparatus moves in response to the fourth redirecting apparatus forcing the portion of the cord oriented in the third direction to deviate from the third direction in response to a user rotating the first rotation plate in a positive rotational direction, or the fourth redirecting apparatus forcing the portion of the cord oriented in the fourth direction to deviate from the fourth direction in response to a user rotating the first rotation plate in a negative rotational direction, thereby causing resistance in response to the movement of the first rotation plate in either the positive rotational direction or the negative rotational direction.

3. The exercise machine of claim 2 wherein the user interface is movably attached adjacent the second column wherein the user interface can be repositioned along the length of the second column.

4. The exercise apparatus of claim 3 further comprising a ballast apparatus, the ballast apparatus including a counterweight; a ballast cord including a first end and a second end, the first end of the ballast cord attached adjacent the counterweight and the second end of the ballast cord attached adjacent the user interface; and a ballast cord redirecting apparatus attached adjacent a first portion of the ballast cord oriented in a primary direction and a second portion of the ballast cord oriented in a secondary direction, whereby the ballast apparatus counters the weight of the user interface so that a user can more easily manipulate the user interface along the second column.

5. The exercise machine of claim 2 wherein the first input apparatus is movably mounted along the first arm member wherein the first input apparatus can be selectively fixedly positioned in different locations along the first arm member.

6. The exercise machine of claim 2 wherein the first shaft is rotatably attached adjacent the first coupling apparatus.

7. The exercise machine of claim 2 wherein the first end of the first engagement extension is rotatably attached adjacent a second end of the first shaft.

8. The exercise machine of claim 2 wherein the cord comprises a plurality of shorter cords attached adjacent one another.

9. The exercise machine of claim 2 wherein the first engagement extension further comprises a first portion and a second portion wherein the first portion of the first engagement extension is oriented at an angle ranging from about 60 degrees to about 120 degrees relative to the second portion of the first engagement extension.

10. The exercise machine of claim 2 wherein the first coupling apparatus further comprises a first pair of redirecting members, wherein the coupling apparatus is configured such that motion of the fourth redirecting apparatus can include motion between the first pair of redirecting members, depending on the amount of force exerted by a user on the first engagement interface member of the exercise machine.

11. The exercise machine of claim 10 wherein the first coupling apparatus further comprises a second pair of redirecting members, wherein the coupling apparatus is configured such that motion of the fourth redirecting apparatus can include motion between the second pair of redirecting members, depending on the amount of force exerted by a user on the first engagement interface member of the exercise machine.

12. The exercise machine of claim 2 further comprising:

a fifth redirecting apparatus attached adjacent the upper beam, the fifth redirecting apparatus for redirecting the orientation of a portion of the cord from a fifth direction to a sixth direction, wherein a second end of the cord is attached adjacent a location of the apparatus that is stationary relative to the second column, the upper beam and/or the foundation;

the user interface, further comprising:

the hub including a sixth redirecting apparatus, the sixth redirecting apparatus for redirecting the orientation of a portion of the cord from the sixth direction to a seventh direction;

a second arm member attached adjacent to and extending from the hub, the second arm member including a seventh redirecting apparatus attached proximate a distal end of the second arm member, the seventh redirecting apparatus for redirecting a portion of the cord from the seventh direction to an eighth direction; and a second input apparatus mounted along the second arm member, the second input apparatus including:

a second shaft;

a second coupling apparatus wherein the second coupling apparatus maintains attachment between the second input apparatus and the second arm member, and wherein the second shaft is attached adjacent the second coupling apparatus;

a second rotation plate rotatable about a second axis defined by the lengthwise orientation of the second shaft;

an eighth redirecting apparatus attached adjacent a distal end of the second rotation plate;

a second engagement interface member wherein the second engagement interface member provides a way for a user to physically engage a user's appendage with the exercise apparatus; and a second engagement extension including a first end and a second end, the first end of the second engagement extension attached adjacent a second end of the second shaft, the second end of the second engagement extension attached adjacent the second engagement interface member; and the movable weight bearing member including a ninth redirecting apparatus wherein the ninth redirecting apparatus is attached adjacent the portion of the cord oriented in the first direction and attached adjacent the portion of the cord oriented in the fifth direction, wherein the weight apparatus moves in response to:

the fourth redirecting apparatus forcing the portion of the cord oriented in the third direction to deviate from the third direction in response to a user rotating the first rotation plate in a positive rotational direction; or the fourth redirecting apparatus forcing the portion of the cord oriented in the fourth direction to deviate from the fourth direction in response to a user rotating the first rotation plate in a negative rotational direction, thereby causing resistance in response to the movement of the first rotation plate in either the positive rotational direction or the negative rotational direction of the first rotation plate;

the eighth redirecting apparatus forcing the portion of the cord oriented in the seventh direction to deviate from the seventh direction in response to a user rotating the second rotation plate in a positive rotational direction; or the eighth redirecting apparatus forcing the portion of the cord oriented in the eighth direction to deviate from the eighth direction in response to a user rotating the second rotation plate in a negative rotational direction, thereby causing resistance in response to the movement of the second rotation plate in either the positive rotational direction or the negative rotational direction of the second rotation plate.

13. The exercise machine of claim 12 wherein the hub further comprises a tenth redirecting apparatus configured for redirecting the orientation of a portion of the cord from the fourth direction to a ninth direction toward a lower portion of the second column, and an eleventh redirecting apparatus configured for redirecting the orientation of a portion of the cord from the eighth direction to a tenth direction toward a lower portion of the second column; and wherein the user interface is movably attached adjacent the second column wherein the user interface can be repositioned along the length of the second column.

14. The exercise machine of claim 13 wherein the user interface is movably attached adjacent the second column wherein the user interface can be repositioned along the length of the second column.

15. The exercise apparatus of claim 14 further comprising a ballast apparatus, the ballast apparatus including a counterweight; a ballast cord including a first end and a second end, the first end of the ballast cord attached adjacent the counterweight and the second end of the ballast cord attached adjacent the user interface; and a ballast cord redirecting apparatus attached adjacent a first portion of the ballast cord oriented in a primary direction and a second portion of the ballast cord oriented in a secondary direction, whereby the ballast apparatus counters the weight of the user interface so that a user can more easily manipulate the user interface along the second column.

16. The exercise machine of claim 13 wherein the first input apparatus is movably mounted along the first arm member wherein the first input apparatus can be selectively fixedly positioned in different locations along the first arm member, and wherein the second input apparatus is movably mounted along the second arm member wherein the second input apparatus can be selectively fixedly positioned in different locations along the second arm member.

17. The exercise machine of claim 13 wherein the first shaft is rotatably attached adjacent the first coupling apparatus and wherein the second shaft is rotatably attached adjacent the second coupling apparatus.

18. The exercise machine of claim 13 wherein the first end of the first engagement extension is rotatably attached adjacent a second end of the first shaft and wherein the first end of the second engagement extension is rotatably attached adjacent a second end of the second shaft.

19. The exercise machine of claim 13 wherein the first engagement extension further comprises a first portion and a second portion wherein the first portion of the first engagement extension is oriented at an angle ranging from about 60 degrees to about 120 degrees relative to the second portion of the first engagement extension, and wherein the second engagement extension further comprises a first portion and a second portion wherein the first portion of the second engagement extension is oriented at an angle ranging from about 60 degrees to about 120 degrees relative to the second portion of the second engagement extension.

20. The exercise machine of claim 13 wherein the first coupling apparatus further comprises a first pair of redirecting members and a second pair of redirecting members, wherein the coupling apparatus is configured such that motion of the fourth redirecting apparatus can include motion between the first pair of redirecting members and the second pair of redirecting members depending on the amount of force exerted by a user on the first engagement interface member of the exercise machine; and wherein the second coupling apparatus further comprises a third pair of redirecting members and a fourth pair of redirecting members, wherein the coupling apparatus is configured such that motion of the eighth redirecting apparatus can include motion between the third pair of redirecting members and the fourth pair of redirecting members depending on the amount of force exerted by a user on the second engagement interface member of the exercise machine.

* * * * *